US010451289B2

(12) United States Patent
Paller

(10) Patent No.: US 10,451,289 B2
(45) Date of Patent: Oct. 22, 2019

(54) FUEL SUPPLY SYSTEM FOR A GAS BURNER ASSEMBLY

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 246 days.

(21) Appl. No.: 15/787,792

(22) Filed: Oct. 19, 2017

(65) Prior Publication Data

US 2019/0120496 A1 Apr. 25, 2019

(51) Int. Cl.

| | |
|---|---|
| ***F24C 3/12*** | (2006.01) |
| ***F24C 3/08*** | (2006.01) |
| ***F23D 14/62*** | (2006.01) |
| ***F23D 23/00*** | (2006.01) |
| ***F23D 14/84*** | (2006.01) |

(Continued)

(52) U.S. Cl.

CPC ..... *F24C 3/122* (2013.01); *F23D 14/065* (2013.01); *F23D 14/62* (2013.01); *F23D 14/84* (2013.01); *F23D 23/00* (2013.01); *F23K 5/005* (2013.01); *F23N 5/184* (2013.01); *F23N 5/188* (2013.01); *F24C 3/082* (2013.01); *F24C 3/085* (2013.01); *F24C 3/126* (2013.01); *F23D 2205/00* (2013.01); *F23D 2208/00* (2013.01); *F23D 2900/14062* (2013.01); *F23N 2005/181* (2013.01); *F23N 2005/182* (2013.01); *F23N 2037/02* (2013.01)

(58) Field of Classification Search

CPC ..... F24C 3/082; F24C 3/085; F24C 3/122; F24C 3/126; F23D 14/065; F23D 14/06; F23D 23/00; F23D 2205/00; F23D 2208/00; F23K 5/005; F23N 2037/02; F23N 5/184; F23N 2005/181; F23N 2005/182

USPC ..... 431/285, 12, 53, 61; 126/39 R

See application file for complete search history.

(56) References Cited

U.S. PATENT DOCUMENTS 2,549,952 A * 4/1951 Wheelock ..... F23D 14/045 236/91 R 3,525,325 A 8/1970 Perl (Continued)

FOREIGN PATENT DOCUMENTS

CN 1076516 A 9/1993

EP 0887590 A1 12/1998

(Continued)

*Primary Examiner* — Gregory L Huson

*Assistant Examiner* — Daniel E Namay

(74) *Attorney, Agent, or Firm* — Dority & Manning, P.A.

(57) ABSTRACT

A fuel supply system for a gas burner assembly. The gas burner assembly includes an inner burner stage positioned concentrically within an outer burner stage. The fuel supply system includes a fuel supply for providing a primary flow of fuel through a primary fuel conduit and a single outlet control valve operably coupled to the primary fuel conduit. A first and second fuel supply conduit split off of the primary fuel conduit and are fluidly coupled with the outer burner stage and the inner burner stage, respectively. A shutoff valve is operably coupled to one of the first fuel supply conduit and the second fuel supply conduit and is configured for closing when a flow rate of fuel through the shutoff valve drops below a predetermined flow rate.

15 Claims, 5 Drawing Sheets

(51) Int. Cl.

| | |
|---|---|
| ***F23N 5/18*** | (2006.01) |
| ***F23D 14/06*** | (2006.01) |
| ***F23K 5/00*** | (2006.01) |

(56) References Cited

U.S. PATENT DOCUMENTS

| | | | | |
|---|---|---|---|---|
| 4,424,793 | A | 1/1984 | Cooperrider | |
| 5,470,018 | A * | 11/1995 | Smith | F23N 1/007 126/116 A |
| 6,322,354 | B1 | 11/2001 | Carbone et al. | |
| 7,901,205 | B2 * | 3/2011 | Trochou | F23D 14/06 126/39 E |
| 8,479,721 | B2 | 7/2013 | Graham et al. | |
| 8,747,108 | B2 * | 6/2014 | Lona Santoyo | F23D 14/06 126/39 B |
| 8,823,714 | B1 * | 9/2014 | Thielvoldt | F23N 1/002 126/500 |
| 8,845,326 | B2 | 9/2014 | Shaffer et al. | |
| 8,960,234 | B2 | 2/2015 | Cadeau et al. | |
| 2005/0142511 | A1 * | 6/2005 | Yam | F23D 14/06 431/285 |
| 2005/0221243 | A1 | 10/2005 | Najewicz et al. | |
| 2005/0239006 | A1 * | 10/2005 | Specht | F23D 14/04 431/12 |
| 2011/0143295 | A1 * | 6/2011 | Fowler | F23D 14/06 431/285 |
| 2014/0060517 | A1 * | 3/2014 | Ren | F23D 14/065 126/39 E |
| 2017/0108226 | A1 * | 4/2017 | Moon | F24C 3/022 |
| 2019/0120495 | A1 * | 4/2019 | Paller | F24C 3/122 |

FOREIGN PATENT DOCUMENTS

| | | | |
|---|---|---|---|
| JP | 2000314510 | A | 11/2000 |
| KR | 100838429 | B1 | 6/2008 |

* cited by examiner

FUEL SUPPLY SYSTEM FOR A GAS BURNER ASSEMBLY

FIELD OF THE INVENTION

The present subject matter relates generally to gas burner assemblies, and more particularly, to fuel supply systems for supplying a mixture of fuel and air into gas burner assemblies.

BACKGROUND OF THE INVENTION

Gas burners are commonly used on the cooktops of household gas cooking appliances including e.g., range ovens and cooktop appliances built into cabinetry. For example, gas cooktops traditionally have at least one gas burner positioned at a cooktop surface for use in heating or cooking an object, such as a cooking utensil and its contents. Gas burners generally include an orifice that directs a flow of gaseous fuel into a fuel chamber. Between the orifice and the fuel chamber, the gaseous fuel entrains air, and the gaseous fuel and air mix within the fuel chamber before being ignited and discharged out of the fuel chamber through a plurality of flame ports.

Certain gas burners include two stages which may operate simultaneously or independently of each other to provide a larger range of heat output at finer increments. Controlling the flow of fuel to each of the respective stages typically requires a dual outlet control valve which may be controlled by a single control knob. However, dual outlet control valves are very expensive. In addition, altering the simmer setting of a dual outlet control valve requires rotating two adjustment screws, which may require additional holes in the cooktop appliance for access. Similarly, maintenance and replacement of dual outlet control valves are more complex than replacing a single outlet control valve.

Accordingly, a cooktop appliance including an improved gas burner assembly with a large operating range and simplified maintenance would be desirable. More particularly, a fuel supply system for a gas burner assembly having multiple burner stages without requiring a complicated and costly dual-outlet control valve would be particularly beneficial.

BRIEF DESCRIPTION OF THE INVENTION

The present disclosure relates generally to a fuel supply system for a gas burner assembly. The gas burner assembly includes an inner burner stage positioned concentrically within an outer burner stage. The fuel supply system includes a fuel supply for providing a primary flow of fuel through a primary fuel conduit and a single outlet control valve operably coupled to the primary fuel conduit. A first and second fuel supply conduit split off of the primary fuel conduit and are fluidly coupled with the outer burner stage and the inner burner stage, respectively. A shutoff valve is operably coupled to one of the first fuel supply conduit and the second fuel supply conduit and is configured for closing when a flow rate of fuel through the shutoff valve drops below a predetermined flow rate. Additional aspects and advantages of the invention will be set forth in part in the following description, or may be apparent from the description, or may be learned through practice of the invention.

In one exemplary embodiment, a cooktop appliance is provided including a top panel and a gas burner assembly positioned at the top panel. The gas burner assembly includes one or more burner bodies defining a first plurality of flame ports, a first fuel chamber in fluid communication with the first plurality of flame ports, a second plurality of flame ports, and a second fuel chamber in fluid communication with the second plurality of flame ports. A fuel supply system includes a fuel supply for providing a primary flow of fuel through a primary fuel conduit and a control valve operably coupled to the primary fuel conduit for regulating the primary flow of fuel. A first fuel supply conduit provides fluid communication between the primary fuel conduit and the first fuel chamber, and a second fuel supply conduit provides fluid communication between the primary fuel conduit and the second fuel chamber. A shutoff valve is operably coupled to one of the first fuel supply conduit and the second fuel supply conduit, the shutoff valve being configured for closing when a flow rate of fuel through the shutoff valve drops below a predetermined flow rate.

In another exemplary embodiment, a fuel supply system for a gas burner assembly is provided. The gas burner assembly includes an inner burner stage positioned concentrically within an outer burner stage. The fuel supply system includes a fuel supply for providing a primary flow of fuel through a primary fuel conduit and a control valve operably coupled to the primary fuel conduit for regulating the primary flow of fuel. A first fuel supply conduit provides fluid communication between the primary fuel conduit and the outer burner stage, and a second fuel supply conduit provides fluid communication between the primary fuel conduit and the inner burner stage. A shutoff valve is operably coupled to one of the first fuel supply conduit and the second fuel supply conduit, the shutoff valve being configured for closing when a flow rate of fuel through the shutoff valve drops below a predetermined flow rate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
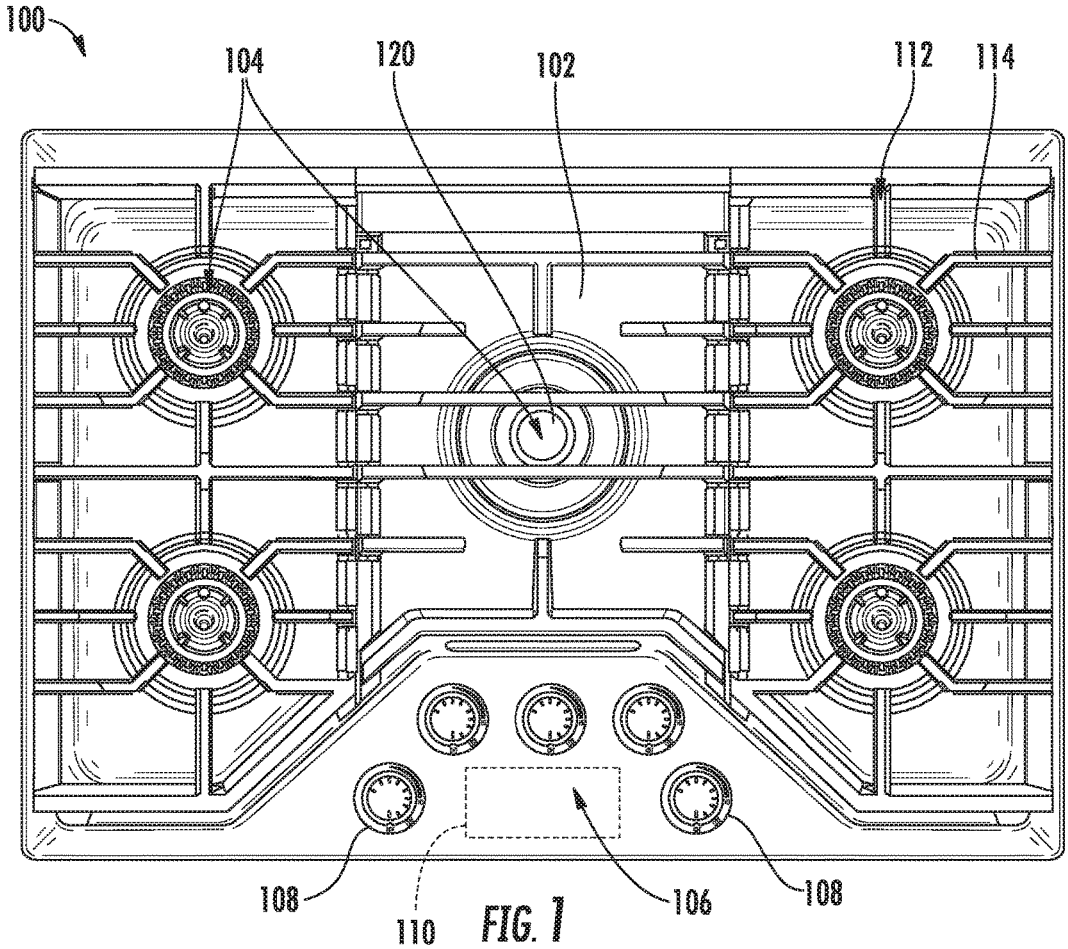
FIG. 1 provides a top view of a cooktop appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, one skilled in the art will appreciate that the present subject matter may apply to any other suitable consumer or commercial appliance. For example, the exemplary gas burner assemblies described below may be used on other types of cooking appliances, such as ranges or oven appliances. Cooktop appliance 100 is used in the discussion below only for the purpose of explanation, and such use is not intended to limit the scope of the present disclosure in any manner.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated exemplary embodiment, a user interface panel or control panel 106 is located within convenient reach of a user of cooktop appliance 100. For this exemplary embodiment, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it should be understood that control knobs 108 and the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

According to the illustrated embodiment, control knobs 108 are located within control panel 106 of cooktop appliance 100. However, it should be appreciated that this location is used only for the purpose of explanation, and that other locations and configurations of control panel 106 and control knobs 108 are possible and within the scope of the present subject matter. Indeed, according to alternative embodiments, control knobs 108 may instead be located directly on top panel 102 or elsewhere on cooktop appliance 100, e.g., on a backsplash, front bezel, or any other suitable surface of cooktop appliance 100. Control panel 106 may also be provided with one or more graphical display devices, such as a digital or analog display device designed to provide operational feedback to a user.

Operation of cooktop appliance 100 is controlled by electromechanical switches or by a controller or processing device 110 (FIG. 1) that is operatively coupled to control panel 106 for user manipulation, e.g., to control the operation of heating elements 104. In response to user manipulation of control panel 106, controller 110 operates the various components of cooktop appliance 100 to execute selected instructions, commands, or other features.

Controller 110 may include a memory and microprocessor, such as a general or special purpose microprocessor operable to execute programming instructions or micro-control code associated with appliance operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 110 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 106 and other components of cooktop appliance 100 may be in communication with controller 110 via one or more signal lines or shared communication busses.

According to the illustrated embodiment, cooktop appliance 100 is a gas cooktop and heating elements 104 are gas burners, such as a gas burner assembly 120 described below. As illustrated, heating elements 104 are positioned within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 112 configured to support a cooking utensil, such as a pot, pan, etc. In general, grates 112 include a plurality of elongated members 114, e.g., formed of cast metal, such as cast iron. The cooking utensil may be placed on the elongated members 114 of each grate 112 such that the cooking utensil rests on an upper surface of elongated members 114 during the cooking process. Heating elements 104 are positioned underneath the various grates 112 such that heating elements 104 provide thermal energy to cooking utensils above top panel 102 by combustion of fuel below the cooking utensils.

Figure 2:
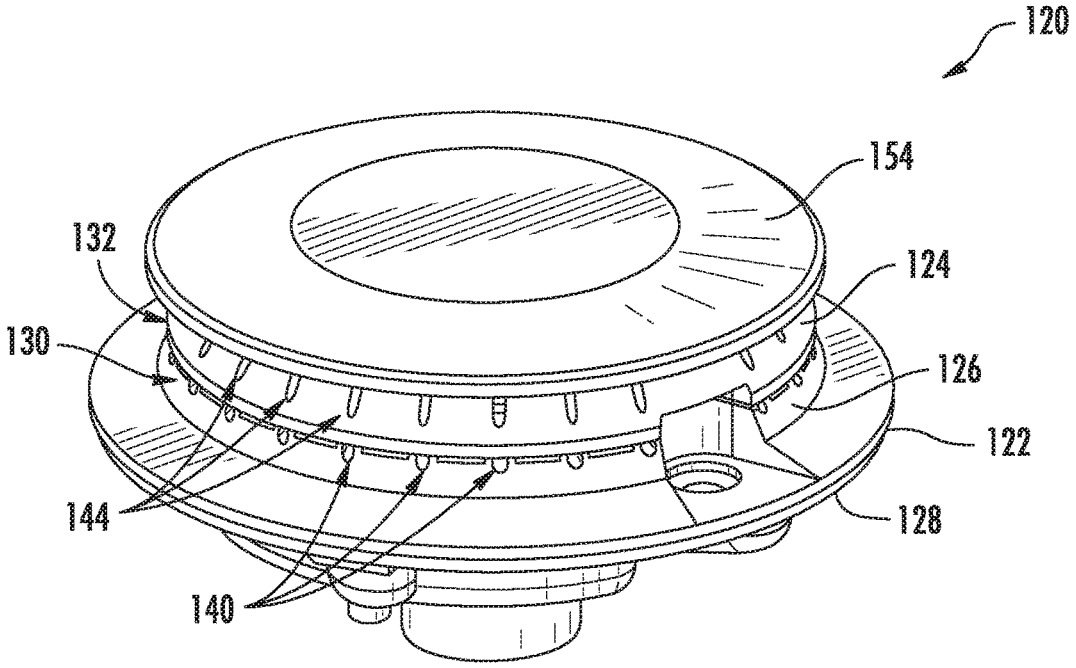
FIG. 2 provides a perspective view of a gas burner assembly of the exemplary cooktop appliance of FIG. 1 according to an exemplary embodiment of the present subject matter.
Figure 3:
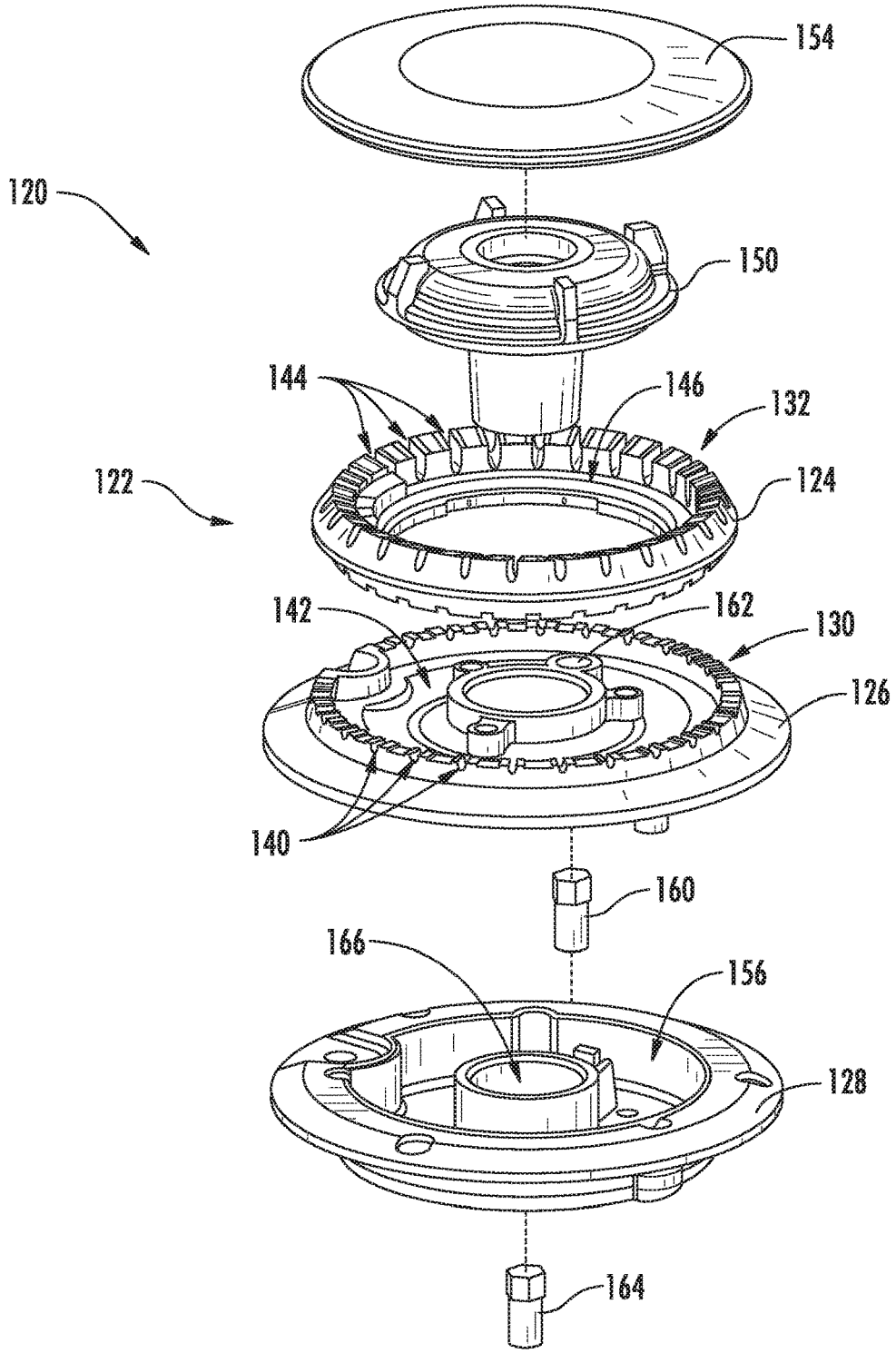
FIG. 3 provides an exploded perspective view of the exemplary gas burner assembly of FIG. 2.
Figure 4:
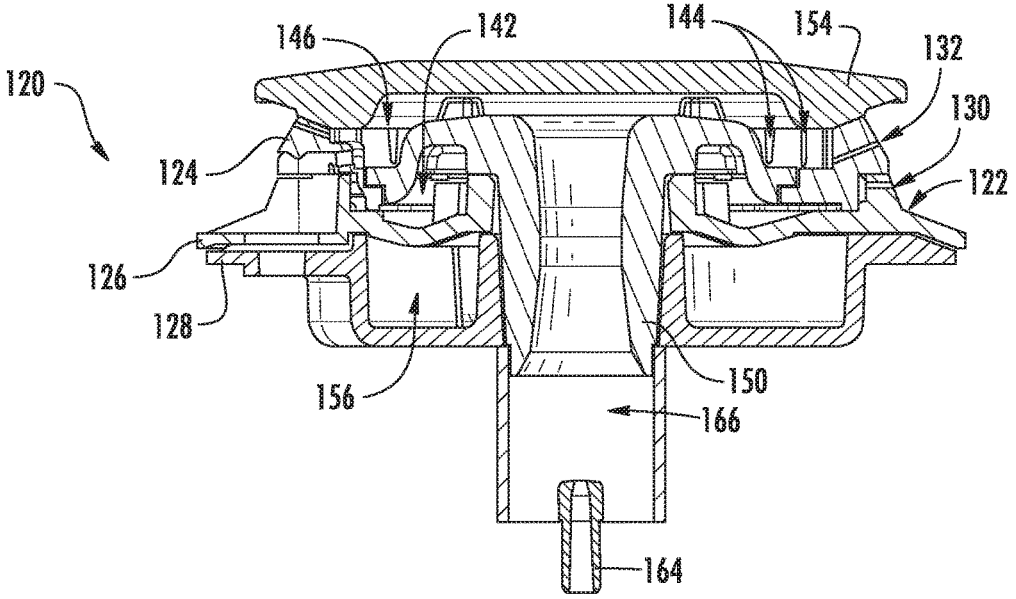
FIG. 4 provides a cross sectional view of the exemplary gas burner assembly of FIG. 2.
Figure 5:
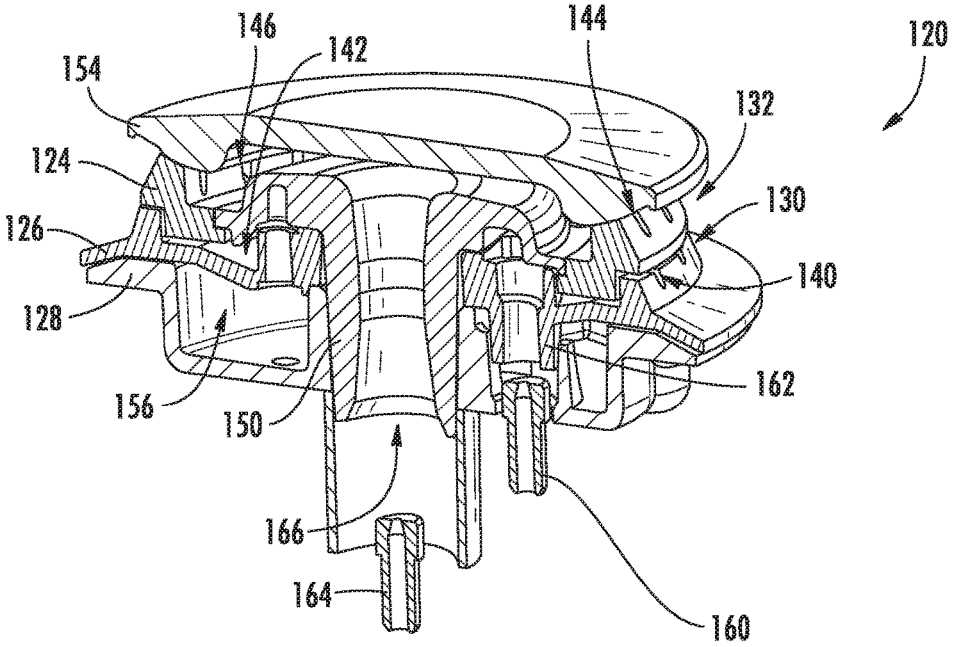
FIG. 5 provides another cross sectional view of the exemplary gas burner assembly of FIG. 2.

FIG. 2 is a perspective view of gas burner assembly 120. FIG. 3 is an exploded view of gas burner assembly 120. FIGS. 4 and 5 are section views of gas burner assembly 120. As an example, gas burner assembly 120 may be used in cooktop appliance 100 (FIG. 1) as one of heating elements 104. However, it will be understood that, while described in greater detail below in the context of cooktop appliance 100, gas burner assembly 120 may be used in or with any suitable appliance in alternative example embodiments.

As may be seen in FIGS. 2 through 5, gas burner assembly 120 includes one or more burner bodies 122, which may include for example, a first burner body 124, a second burner body 126, and a third burner body 128. Burner bodies 122 generally define a first burner ring or stage 130 (e.g., an outer burner) and a second burner ring or stage 132 (e.g., an inner burner). More specifically, first burner stage 130 generally includes a first plurality of flame ports 140 and a first fuel chamber 142 which are defined by first burner body 124 and second burner body 126. Similarly, second burner stage 132 generally includes a second plurality of flame ports 144 and a second fuel chamber 146 which are defined at least in part by first burner body 124.

Gas burner assembly 120 may also include an air duct 150 and a cap 154. First plurality of flame ports 140 may be defined on second burner body 126, e.g., at a circular outer wall of second burner body 126. Similarly, second plurality of flame ports 144 may be defined on first burner body 124, e.g., at a circular outer wall of first burner body 124. Second fuel chamber 146 may be defined by inner surfaces of cap 154, air duct 150, and first burner body 124. First fuel chamber 142 may be defined by inner surfaces of air duct 150, first burner body 124, and second burner body 126. First fuel chamber 142 is separate or independent from second fuel chamber 146 within gas burner assembly 120. Thus, first fuel chamber 142 is not in flow communication with second fuel chamber 146 within gas burner assembly 120. In addition, an air chamber 156 may be defined by second burner body 126 and third burner body 128.

As may be seen in FIGS. 2 through 4, first plurality of flame ports 140 may be positioned concentric with second plurality of flame ports 144. Further, first plurality of flame ports 140 (and first burner stage 130) may be positioned below second plurality of flame ports 144 (and second burner stage 132). Such positioning of first burner stage 130 relative to second burner stage 132 may improve combustion of gaseous fuel when both stages 130, 132 are ignited. For example, flames at first burner stage 130 may assist with lighting gaseous fuel at second burner stage 132 due to the position of first burner stage 130 below second burner stage 132.

According to the exemplary illustrated embodiment, first burner stage 130 and second burner stage 132 are normally aspirated burners that relies on the energy available in the form of pressure from the fuel supplied to the gas burner to entrain air for combustion. In this regard, for example, as best shown in FIGS. 3 and 5 a first orifice 160 is positioned at, e.g., directly below and/or concentric with, a Venturi inlet passage 162 on second burner body 126. Venturi inlet passage 162 is in fluid communication with first fuel chamber 142. Thus, gaseous fuel from first orifice 160 may flow into first fuel chamber 142 through Venturi inlet passage 162. From first fuel chamber 142, the mixture of gaseous fuel and air may flow through and be combusted at first plurality of flame ports 140. Thus, first plurality of flame ports 140 are in fluid communication with first fuel chamber 142 such that the mixture of gaseous fuel and air within first fuel chamber 142 is flowable through first plurality of flame ports 140. Venturi inlet passage 162 assists with naturally aspirating first burner stage 130. For example, Venturi inlet passage 162 may increase a speed and/or decrease a pressure of gaseous fuel flowing from first orifice 160 such that Venturi inlet passage 162 entrains air from air chamber 156 into Venturi inlet passage 162.

Similarly, for example, as best shown in FIGS. 3 through 5, a second orifice 164 is positioned at, e.g., directly below and/or concentric with, a second stage inlet passage 166 defined by third burner body 128. Second stage inlet passage 166 is in fluid communication with second fuel chamber 146 such that gaseous fuel from second orifice 164 may flow into second fuel chamber 146 through second stage inlet passage 166. From second fuel chamber 146, the mixture of gaseous fuel and air may flow through and be combusted at second plurality of flame ports 144. Thus, second plurality of flame ports 144 are in fluid communication with second fuel chamber 146 such that the mixture of gaseous fuel and air within second fuel chamber 146 is flowable through second plurality of flame ports 144. Second stage inlet passage 166 may define any suitable shape or profile, e.g., similar to Venturi inlet passage 162, to assist with naturally aspirating second burner stage 132.

Figure 6:
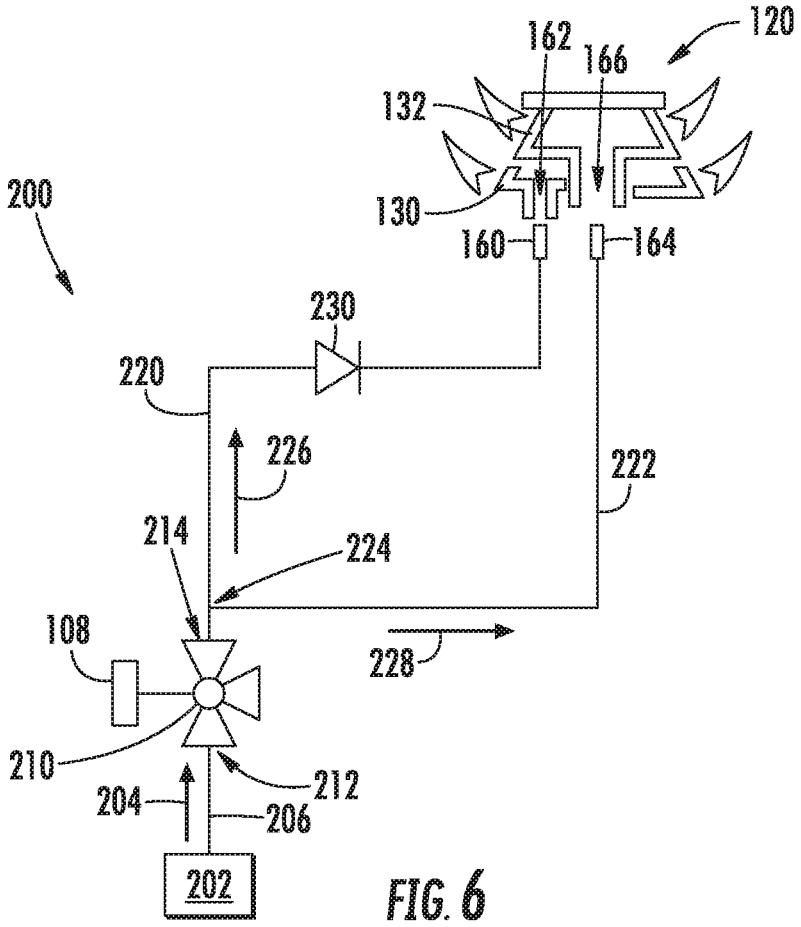
FIG. 6 provides a schematic view of a fuel supply system for providing a flow of fuel to a gas burner assembly according to an example embodiment of the present subject matter.

Referring now to FIG. 6, a schematic view of gas burner assembly 120 and a fuel supply system 200 will be described according to an exemplary embodiment. For the purpose of explanation, simplified renderings of first burner stage 130 and second burner stage 132 of gas burner assembly 120 are illustrated in schematic form in FIG. 6. Similar reference numerals may be used to refer to the same or analogous features throughout the figures. In addition, although fuel supply system 200 is illustrated as being used with gas burner assembly 120, it should be appreciated that fuel supply system 200 as described herein may be used in any suitable gas burner assembly and in any suitable cooktop appliance.

In general, fuel supply system 200 is configured for selectively supplying gaseous fuel such as propane or natural gas to first burner stage 130 and second burner stage 132 to regulate the amount of heat generated by the respective stages. In particular, fuel supply system 200 regulates the output of both first and second burner stages 130, 132 depending upon the desired output of gas burner assembly 120 selected by a user of gas burner assembly 120, e.g., using control knob 108. Thus, first burner stage 130 is separate or independent from second burner stage 132, e.g., such that first burner stage 130 is not in fluid communication with second burner stage 132 within gas burner assembly 120. In such manner, gaseous fuel within gas burner assembly 120 does not flow between first and second burner stages 130, 132.

As shown in FIG. 6, fuel supply system 200 may include a single fuel supply 202, such as a natural gas supply line or a propane tank. Gaseous fuel (e.g., natural gas or propane) is flowable from the pressurized fuel supply 202 to first burner stage 130 and second burner stage 132. More specifically, fuel supply 202 selectively provides a primary flow of fuel (indicated by reference numeral 204) through a primary fuel conduit 206.

Fuel supply system 200 may further include a control valve 210 operably coupled to primary fuel conduit 206 for selectively directing a metered amount of fuel to gas burner assembly 120. More specifically, according to the illustrated embodiment, control valve 210 is a single outlet control valve including a valve inlet 212 fluidly coupled with fuel supply 202 and a valve outlet 214 fluidly coupled with primary fuel conduit 206 for regulating the primary flow of fuel 204. According to the exemplary embodiment, control valve 210 is operably coupled with control knob 108 such that a user of gas burner assembly 120 may control the primary flow of fuel 204.

Fuel supply system 200 includes a first fuel supply conduit 220 and a second fuel supply conduit 222 that are split off of primary fuel conduit 206 at a junction 224, e.g., via a plumbing tee, wye, or any other suitable splitting device. Junction 224 may be positioned downstream of control valve 210 and first fuel supply conduit 220 and second fuel supply conduit 222 may be plumbed in parallel between junction 224 and gas burner assembly 120. More specifically, first fuel supply conduit 220 provides fluid communication between primary fuel conduit 206 and first fuel chamber 142 (e.g., of the outer burner stage or first burner stage 130). Similarly, second fuel supply conduit 222 provides fluid communication between primary fuel conduit 206 and second fuel chamber 146 (e.g., of the inner burner stage or second burner stage 132). In this manner, primary flow of fuel 204 may be split at junction 224 into a first flow of fuel 226 flowing through first fuel supply conduit 220 and a second flow of fuel 228 flowing through second fuel supply conduit 222.

It may frequently be desirable to have the ability to independently control first burner stage 130 and second burner stage 132 using fuel supply system 200. For example, to achieve a very low simmer rate, it may be desirable to turn off first burner stage 130 and operate second burner stage 132 at a low flow rate. Therefore, according to an exemplary embodiment, fuel supply system 200 may further include a shutoff valve 230 that is operably coupled to one of first fuel supply conduit 220 and second fuel supply conduit 222. Shutoff valve 230 may generally be configured for closing when a flow rate of fuel through shutoff valve 230 (or through the associated conduit 220, 222) drops below a predetermined flow rate. The predetermined flow rate may be selected by a user, may be associated with a specific condition or event, may be selected to correspond to an operating condition of fuel supply system 200, or may be determined in any other suitable manner.

According to one embodiment, shutoff valve 230 is coupled to first fuel supply conduit 220 to regulate the first flow of fuel 226. In this regard, shutoff valve 230 may be configured for stopping the first flow of fuel 226 when a flow rate of the first flow of fuel 226 drops below some predetermined level, such as the flow rate associated with a low simmer operation of gas burner assembly 120. In this manner, when a user rotates knob 108 to the simmer position, the flow rate through first fuel supply conduit 220 drops below the simmer rate and shutoff valve 230 stops the first flow of fuel 226 altogether. Thus, the primary flow of fuel 204 passes entirely through primary fuel conduit 206 to second fuel supply conduit 222 and second burner stage 132 at the simmer flow rate. It should be appreciated that shutoff valve 230 could alternatively be used to regulate the primary flow of fuel 204 or the second flow of fuel 228 passing through second fuel supply conduit 222.

Shutoff valve 230 may be any suitable type of valve or device within fuel supply system 200 that is configured for selectively stopping the flow of fuel through one or more fuel conduits. For example, according to the exemplary embodiment, shutoff valve 230 is a one-way valve that has a cracking pressure substantially equivalent to the predetermined flow rate. In this manner, continuing the example from above, when the flow rate of the first flow of fuel 226 in first fuel supply conduit 220 drops below the predetermined flow rate, the flap of the one-way valve closes, thus preventing any further flow of fuel through first fuel supply conduit 220. According to alternative embodiments, shutoff valve 230 may be any other suitable type of valve for shutting down at any other suitable pressure.

Notably, fuel supply system 200 described above may provide several advantages relative to conventional fuel supply assemblies for a gas burner assembly, such as gas burner assembly 120. For example, independent control of first burner stage 130 and second burner stage 132 may be achieved without necessitating a costly dual outlet control valve. In addition, using control valve 210 in conjunction with shutoff valve 230 enable improved versatility in the range and precision of burner operation. Moreover, maintenance costs may be reduced and the reliability of fuel supply system 200 may be improved. Other benefits and advantages of the present subject matter will be apparent to those skilled in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a top panel;

a gas burner assembly positioned at the top panel, the gas burner assembly comprising one or more burner bodies defining a first plurality of flame ports, a first fuel chamber in fluid communication with the first plurality of flame ports, a second plurality of flame ports, and a second fuel chamber in fluid communication with the second plurality of flame ports; and a fuel supply system comprising:

a fuel supply for providing a primary flow of fuel through a primary fuel conduit;

a single outlet control valve operably coupled to the primary fuel conduit for regulating the primary flow of fuel;

a first fuel supply conduit providing fluid communication between the primary fuel conduit and the first fuel chamber;

a second fuel supply conduit providing fluid communication between the primary fuel conduit and the second fuel chamber; and a shutoff valve operably coupled to one of the first fuel supply conduit and the second fuel supply conduit, the shutoff valve being configured for closing when a flow rate of fuel through the shutoff valve drops below a predetermined flow rate.

2. The cooktop appliance of claim 1, wherein the shutoff valve is operably coupled to the first fuel supply conduit.

3. The cooktop appliance of claim 1, wherein the first plurality of flame ports define an outer burner stage and the second plurality of flame ports define an inner burner stage positioned concentrically within the outer burner stage.

4. The cooktop appliance of claim 1, wherein the shutoff valve is a one-way valve that has a cracking pressure substantially equivalent to the predetermined flow rate.

5. The cooktop appliance of claim 1, wherein the predetermined flow rate is equivalent to a simmer flow rate.

6. The cooktop appliance of claim 1, comprising a control knob operably coupled to the control valve and being rotatable for controlling the position of the control valve.

7. The cooktop appliance of claim 1, wherein the first fuel supply conduit and the second fuel supply conduit are split off of the primary fuel conduit at a junction downstream of the control valve and are plumbed in parallel between the junction and the gas burner assembly.

8. The cooktop appliance of claim 1, wherein the control valve comprises a valve inlet in fluid communication with the fuel supply and a valve outlet in fluid communication with the primary supply conduit, the control valve being configured for regulating the primary flow of fuel through the primary supply conduit.

9. A fuel supply system for a gas burner assembly, the gas burner assembly comprising an inner burner stage positioned concentrically within an outer burner stage, the fuel supply system comprising:

a fuel supply for providing a primary flow of fuel through a primary fuel conduit;

a single outlet control valve operably coupled to the primary fuel conduit for regulating the primary flow of fuel;

a first fuel supply conduit providing fluid communication between the primary fuel conduit and the outer burner stage;

a second fuel supply conduit providing fluid communication between the primary fuel conduit and the inner burner stage; and a shutoff valve operably coupled to one of the first fuel supply conduit and the second fuel supply conduit, the shutoff valve being configured for closing when a flow rate of fuel through the shutoff valve drops below a predetermined flow rate.

10. The fuel supply system of claim 9, wherein the shutoff valve is operably coupled to the first fuel supply conduit.

11. The fuel supply system of claim 9, wherein the shutoff valve is a one-way valve that has a cracking pressure substantially equivalent to the predetermined flow rate.

12. The fuel supply system of claim 9, wherein the predetermined flow rate is equivalent to a simmer flow rate.

13. The fuel supply system of claim 9, comprising a control knob operably coupled to the control valve and being rotatable for controlling the position of the control valve.

14. The fuel supply system of claim 9, wherein the first fuel supply conduit and the second fuel supply conduit are split off of the primary fuel conduit at a junction downstream of the control valve and are plumbed in parallel between the junction and the gas burner assembly.

15. The fuel supply system of claim 9, wherein the control valve comprises a valve inlet in fluid communication with the fuel supply and a valve outlet in fluid communication with the primary supply conduit, the control valve being configured for regulating the primary flow of fuel through the primary supply conduit.

* * * * *